US006770172B2

(12) United States Patent
Rökman et al.

(10) Patent No.: US 6,770,172 B2
(45) Date of Patent: Aug. 3, 2004

(54) METHOD OF MAKING PRESS FELT, AND PRESS FELT

(75) Inventors: Bo Rökman, Kangasala (FI); Kari Hyvönen, Tampere (FI); Tauno Virtanen, Tampere (FI)

(73) Assignee: Tamfelt Oyj Abp, Tampere (FI)

( * ) Notice: Subject to any disclaimer, the term of this patent is extended or adjusted under 35 U.S.C. 154(b) by 0 days.

(21) Appl. No.: 10/438,893

(22) Filed: May 16, 2003

(65) Prior Publication Data

US 2003/0192665 A1 Oct. 16, 2003

Related U.S. Application Data

(63) Continuation of application No. PCT/FI01/01109, filed on Dec. 17, 2001.

(30) Foreign Application Priority Data

Dec. 18, 2000 (FI) ..... 20002775

(51) Int. Cl.[7] ..... D21F 3/00; D21F 7/08

(52) U.S. Cl. ..... 162/358.2; 162/900; 28/110; 428/192; 428/193; 428/212; 442/271

(58) Field of Search ..... 139/383 A, 383 AA, 139/425 A; 162/358.1, 358.2, 900, 902, 903, 199, 348; 428/192, 193, 212, 222, 223; 442/268–275, 203–208; 28/110, 141; 34/116, 123

(56) References Cited

U.S. PATENT DOCUMENTS 3,867,766 A * 2/1975 Wagner ..... 34/95
4,300,982 A * 11/1981 Romanski ..... 162/358.2
4,414,263 A 11/1983 Miller et al.
4,460,023 A * 7/1984 Mullaney ..... 139/383 A
4,649,964 A * 3/1987 Smith ..... 139/383 A
4,784,190 A 11/1988 Mullaney
4,857,391 A * 8/1989 Westhead ..... 428/222
5,118,557 A * 6/1992 Barnewall ..... 442/223
5,268,076 A 12/1993 Best et al.
5,397,438 A * 3/1995 Nyberg et al. ..... 162/207
5,731,059 A * 3/1998 Smith et al. ..... 428/192
5,829,488 A 11/1998 Fagerholm et al.
6,116,156 A * 9/2000 Schiel et al. ..... 100/118
6,503,602 B1 * 1/2003 Crosby ..... 428/193

FOREIGN PATENT DOCUMENTS

| | | |
|---|---|---|
| CA | 2044385 | 6/1999 |
| EP | 0 802 280 A3 | 4/1998 |
| FI | 59440 | 10/1981 |
| FI | 96704 | 8/1996 |
| WO | WO 02/10510 A1 | 2/2002 |

* cited by examiner

*Primary Examiner*—Steven P. Griffin
*Assistant Examiner*—Eric Hug
(74) *Attorney, Agent, or Firm*—Oliff & Berridge, PLC

(57) ABSTRACT

A method of making a press felt, and a press felt. The press felt comprises a continuous base fabric in the lateral direction, and at least one batt fiber layer. The closed-loop base fabric is made of longitudinal and transverse yarns. The properties of the press felt, such as permeance, are arranged to be different in edge portions of the press felt from the midportion of the felt.

11 Claims, 4 Drawing Sheets

METHOD OF MAKING PRESS FELT, AND PRESS FELT

This is a Continuation of Application No. PCT/FI01/01109 filed Dec. 17, 2001. The entire disclosure of the prior application is hereby incorporated by reference herein in its entirety.

FIELD OF THE INVENTION

The invention relates to a method of making a press felt, the method comprising forming at least one base fabric preform, and making the at least one base fabric preform into a closed-loop base fabric having predetermined dimensions in the cross machine direction and the machine direction of a paper machine and a first and a second longitudinal outer edges, and attaching at least one batt fibre layer onto the base fabric.

The invention also relates to a press felt comprising a closed-loop base fabric and at least one batt fibre layer attached onto the base fabric.

BACKGROUND OF THE INVENTION

The aim of a press section in a paper machine is to drain a web as efficiently as possible without causing any deterioration in the quality of the web, however. From the viewpoint of energy consumption, it is most advantageous to remove as much water as possible already at the press section, whereby there is less need to dry the paper web at subsequent sections of the paper machine. Depending on the press structure, the press section of the paper machine employs a press felt on one or both sides of the web to be dried, into which press felt the water in the web is absorbed. The purpose of the press felt is to transport the water away after pressing without allowing it to migrate back into the web. In pressing, the paper web is conveyed on the felt to a gap between two rolls, i.e. so-called nip. Typically, there are one to four nips in succession, and in each nip water is pressed out of the web into the felt. Consequently, the felt should be such that the water can well be absorbed into the felt pressed in the roll nip. The press felts comprise a base fabric that provides the felt with a necessary space for water, for instance. To make the felt surface smooth, batt fibre is needled onto at least a base fabric surface facing the paper web. The batt fibre thus prevents markings from being produced on the web to be drained. In addition, by means of the batt fibre the water retention capacity of the felt can be adjusted to a desired level such that water is prevented from migrating back from the felt into the web, i.e. so-called rewetting is prevented.

Several alternative ways to form the base fabric are known. It is possible to weave the base fabric on a weaving machine directly into a seamless, endless loop of uniform quality. It is also possible to weave base fabrics provided with seam loops, and a desired number of base fabrics can be interconnected to form a closed loop. In that case the seam loops at the ends of the base fabrics are intermeshed and connected by inserting a seam yarn in a channel formed by the seam loops. The base fabric can be woven in flat or horseshoe form in known manners.

Irrespective of the structure and how the base fabric of the press felt is woven, known press felts have a drawback that longitudinal edge portions thereof act differently at the press section as compared with the midportion. It is possible for moisture to drain better at the edges than in the middle. Therefore, it is difficult to make the web to be dried homogeneous in the cross machine direction. Variation often occurs in the cross machine direction measuring profile of the web. It is possible to attempt to avoid the problem by adjusting the control parameters of the paper machine, but it is very complicated and demanding.

One more drawback of the known press felts is that the web does not accompany the press felt in a desired manner at the press section, or alternatively, the web does not always get detached from the felt in the desired manner. The reason is that at the press section the web adheres to the edge portions of the felt in a different manner as compared with the midportion. In general, the felt edges get clogged faster than the midportion, which changes so-called pick-up properties of the felt. Defective pick-up may cause cockle and other quality problems in the web to be dried, and deteriorate the runability of the paper machine.

BRIEF DESCRIPTION OF THE INVENTION

The object of the present invention is to provide a novel and improved press felt for a paper machine, and a method of making the press felt.

The method of the invention is characterized by forming a base fabric of one or more base fabric preforms that are continuous in the transverse direction; providing both of the longitudinal edges of the press felt with longitudinal edge portions of a predetermined width from the longitudinal outer edge of the press felt and providing a midportion in the longitudinal direction of the press felt between the edge portions; and by arranging the structure of the press felt edge portions to be different from the midportion.

The press felt of the invention is further characterized in that the base fabric is continuous in the transverse direction of the press felt; that the press felt comprises longitudinal edge portions of a predetermined width in the transverse direction of the press felt and a midportion between said edge portions; and that the structure of the edge portions is different from the midportion.

The basic idea of the invention is forming a press felt, whose properties in the longitudinal edge portions of predetermined width differ in a pre-planned manner from the properties of the midportion between the edge portions. The edge portions of the press felt can be made to differ in e.g. permeance, grammage, surface properties, structure or other properties concerned, from the midportion of the felt. The invention has an advantage that running the paper machine is easier, because cross-machine direction variation in the moisture profile need not be compensated in a complicated manner by adjusting the control parameters of the paper machine as is the case with known press felts, in which the press felt is of substantially uniform quality throughout the press felt width. One more advantage is that the properties of the edge portions and the midportions of the felt can be arranged such that the felt pick-up takes place in a desired manner. The felt transfer is thus controlled in the press section, when the web adheres to and correspondingly becomes detached from the press felt as planned. Thus, it is possible to avoid quality problems associated with the web transfer. Moreover, the runability of the paper machine is better.

The basic idea of an embodiment of the invention is that the base fabric of the press felt comprises at least one base fabric preform that is substantially of the same width as the press felt and is woven such that yarn density at the base fabric edges is higher, or alternatively, lower than in the midportion. A change in the yarn density from higher to lower between the edge portions and the midportion can also be arranged gradually for a desired transition distance.

The basic idea of an embodiment of the invention is that the batt fibre attached to base fabric is employed to adjust the properties of the press felt in the cross-machine direction. The batt fibre layers to be attached can be denser or more open in the edge portions than in the midportion of the felt. Further, the number of batt fibre layers attached onto the midportion and edge portions of the felt can contribute to the press felt properties in the cross-machine direction. The solution has an advantage that it is possible to manufacture in advance standard base fabrics which can be customized with batt fibre to have desired properties in the cross-machine direction.

The basic idea of an embodiment of the invention is that the press felt is treated during manufacture with a suitable polymer material such that the polymer material penetrates into the felt partly clogging its structure. The treatment allows manufacture of a press felt with desired permeance in the cross-machine direction in the different portions. The solution has an advantage that it is possible to manufacture in advance press felts with predetermined properties, and not until the base fabric assembly and batt fibre attachment are the cross-machine direction properties of each press felt customized by means of the polymer material to be the desired ones.

The basic idea of an embodiment of the invention is that the press felt structure is provided, in desired cross-machine direction portions, with an extra, separate material layer, such as a polymer film provided with openings, by means of which material layer the permeance properties of the felt are adjusted to be desired in the cross-machine direction portions.

BRIEF DESCRIPTION OF THE DRAWINGS

The invention will be described in greater detail in the attached drawings, wherein.

Like reference numerals refer to like parts in the figures. For clarity, the figures are simplified. The various structural layers of the press felt in FIGS. 3 to 9 are depicted as simple, cross-sectional blocks.

DETAILED DESCRIPTION OF THE INVENTION

Figure 1:
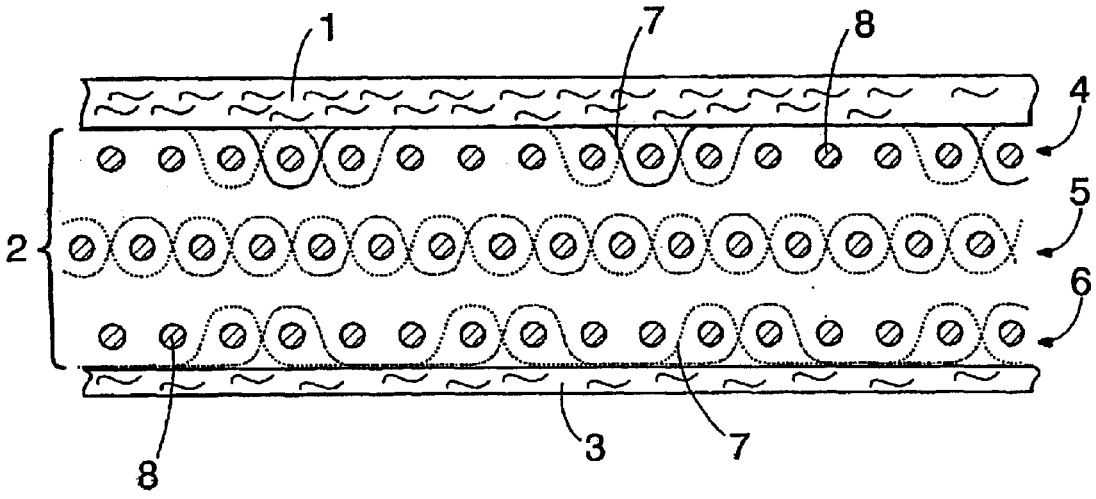
FIG. 1 is a schematic view of a press felt cut open in the direction of warp yarns.

The press felt in FIG. 1 comprises three interlinked layers, the topmost of which, i.e. the layer facing the web is a batt fibre layer 1. Below the batt fibre layer there is a woven base fabric 2, and lowermost there is still one layer of batt fibre 3. The web-side batt fibre 1 prevents markings, i.e. patterning resulting from the weave of the base fabric, from being produced on the surface of the paper web. Typically, the batt fibre layer consists of at least two thinner plies to be needled separately one on top of the other. On the top surface of the batt fibre layer there is, in general, finer batt fibre and coarser batt fibre at the bottom. A batt fibre layer is not necessary at the bottom of the press felt. The base fabric 2 of the press felt is manufactured of warp yarns and weft yarns by weaving. In general, the base fabric has relatively loose texture in order to provide a sufficient space for water, and suitable openness. The laminated base fabric in the figure comprises three superimposed, independent layers 4, 5 and 6. Each layer comprises its own warp yarns 7 and weft yarns 8, which interlace in a desired manner. For clarity, the figures only show a few of the yarns in the weave. It is obvious that the structure of the base fabric 2 can comprise one or more layers.

Figure 2:
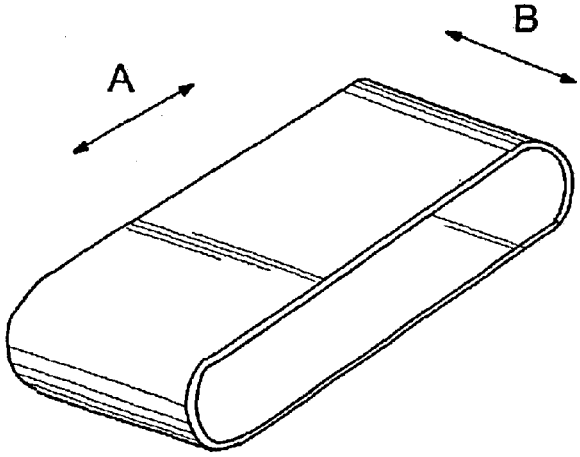
FIG. 2 is a schematic and perspective view of a press felt.

As can be seen in FIG. 2, the press felt is made into a closed loop, which is run in the machine direction A guided by rolls of the paper machine press section. In the cross-machine direction B the width of the press felt corresponds to that of the paper machine. In known solutions, the press felt is of substantially uniform quality in the machine and cross-machine directions of the paper machine as regards the base fabric and the batt fibre layers. Whereas, in the solution of the invention the press felt properties are different in cross-machine direction portions, as will be described in FIGS. 3 to 11 hereafter.

Figure 3:
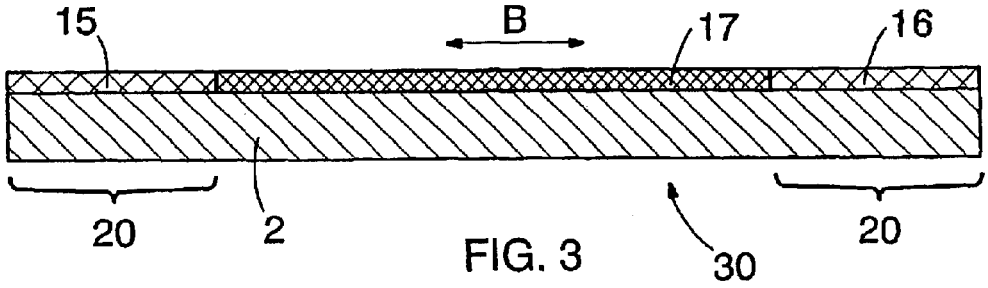
FIGS. 3 to 6 are schematic views of press felts cut open and seen in the running direction A.

FIG. 3 shows a press felt structure, in which the base fabric 2 is a continuous element and also of substantially uniform quality in the cross-machine direction B. In this particular case, the properties of the press felt are modified by means of batt fibre layers 15, 16 and 17 attached onto the upper surface of the base fabric to become desired in the cross-machine direction portions. In the example of the figure, looser batt fibre is attached to the edge portions 20 than to the midportion 30 of the felt. The edge batt fibres 15 and 16 can be of a finer or coarser quality than the batt fibre in the middle 17, as desired. In addition, it is possible to select the surface properties of the batt fibre layers to be desired.

Thanks to the solution of the invention, the edge portions of the felt can be formed to have a looser texture than the midportion, and consequently the edges get clogged slower during use, and the desired pick-up can be maintained longer than before.

Figure 4:
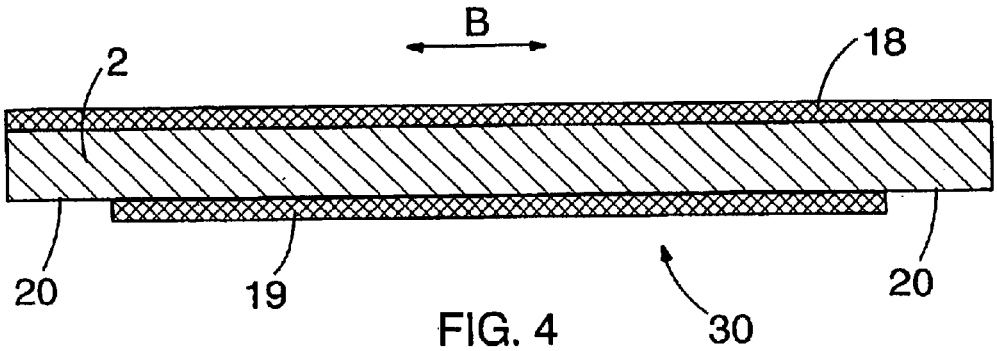

FIG. 4 shows a solution, in which surface batt fibre 18 that is substantially homogeneous throughout is attached to the web-side surface of the base fabric 2 that is substantially homogeneous throughout. Here the properties of the press felt in the cross-machine portions are amended such that bottom batt fibre 19 attached to the felt bottom is narrower than the base fabric 2. The bottom batt fibre 19 is arranged on the midportion of the felt, and there is no bottom batt fibre on the edge portions 20. Alternatively the structure comprises two narrow bottom batt fibre layers that are attached to the longitudinal felt edges and the midportion remains completely without bottom batt fibre. Corresponding batt fibre layer disposition can also be applied to the formation of other batt fibre layers.

Figure 5:
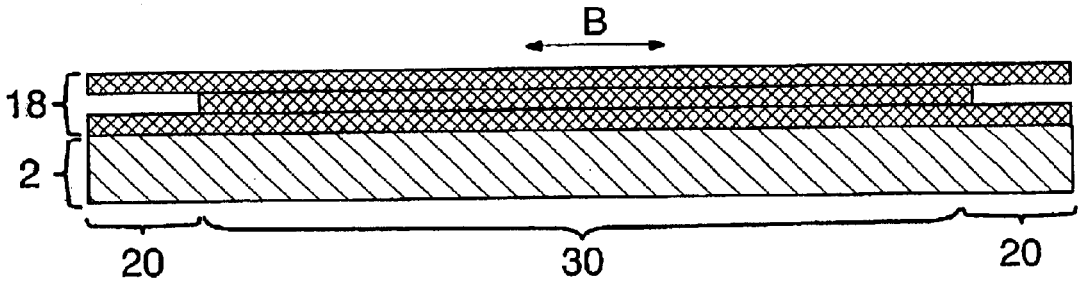

FIG. 5 shows a solution, in which the surface batt fibre 18 consists of three layers, the midmost covering only the midportion 30 of the felt and the other layers extending from the first edge to the second edge of the felt.

On the other hand, batt fibre layers extending from edge to edge can be one or more, and an individual batt fibre layer can have batt fibre portions that are different in density and/or grammage on the edges or in the middle. The edges of the individual batt fibre layer can be adjusted in the needling machine.

Figure 6:
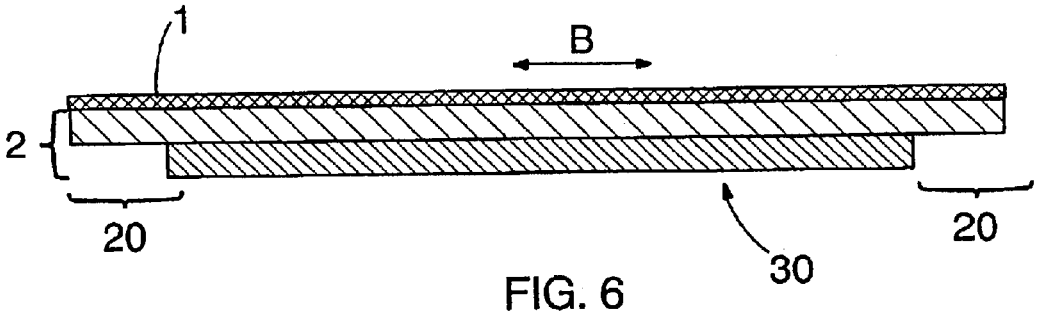

FIG. 6 shows a solution, in which the lower layer of the base fabric covers only the midportion 30 of the felt. The upper layer of the base fabric extends from the first edge to the second edge of the felt. Both the upper layer and the lower layer of the base fabric are continuous pieces in the transverse direction B.

Figure 7:
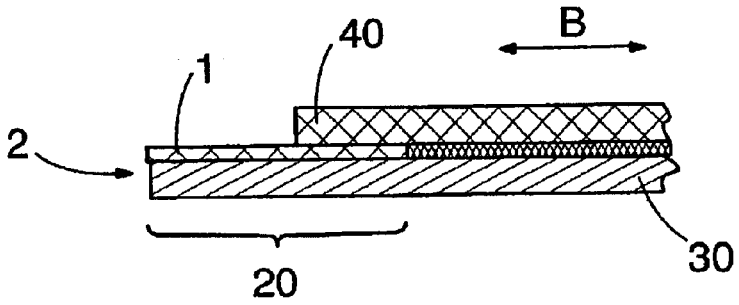
FIG. 7 is a schematic view of an edge portion of the press felt according to the invention, cut open and seen in the running direction.

FIG. 7 shows an edge portion of the felt. As appears, at the edge the press felt extends longer than the web 40 to be dried. The edge portion 20 of the base fabric is designed such that it extends for a predetermined distance from the felt edge over the edge portion of the web 40 to be dried.

Figure 8:
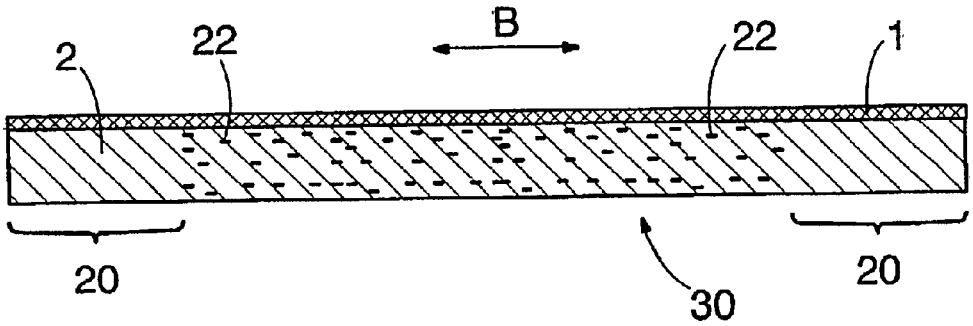
FIGS. 8 and 9 also show schematically structures of base fabric preforms cut open and seen in the running direction A.

FIG. 8 shows a cross section of a press felt comprising a base fabric 2 of substantially uniform quality and surface batt fibre 1. In this case, midportions 30 of the press felt are treated with a suitable polymer material 22, such as acrylic resin, styrene butadiene resin, polyvinyl chloride or polyurethane. Alternatively, only the edge portions 20 of the felt are treated. The treatment can be carried out after the assembly of the base fabric and the attachment of the necessary batt fibre layers thereto. The polymer material can be applied by spraying, brushing, rolling, immersing, or by any other method, to the desired transverse portions in the structure of the press felt. In this case the polymer arranged on the edge portions penetrates into the base fabric and surface batt fibre of the felt and clogs the structure of the midportions. Consequently, the permeance of the press felt decreases in the midportion. By means of the polymer it is also possible to influence the surface properties of the felt. The polymer can be hydrophobic or hydrophilic, depending on the case. In some cases, the polymer treatment can be performed on only parts of the base fabric prior to the attachment of batt fibre.

Figure 9:
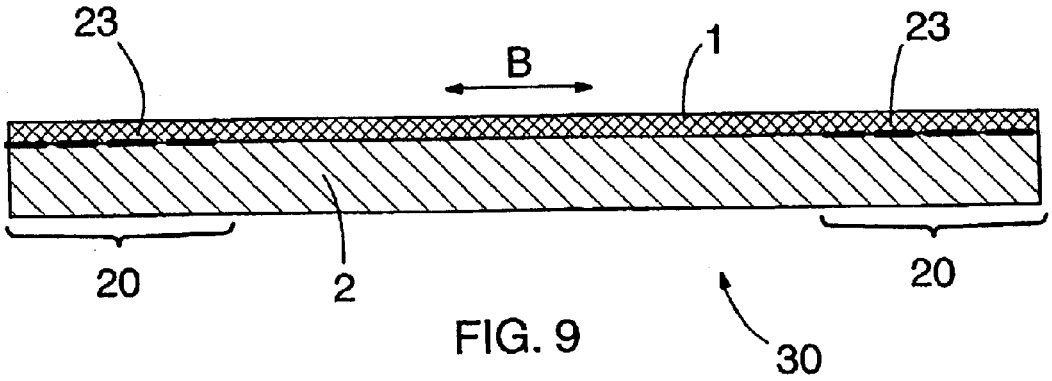

FIG. 9 shows a cross section of a press felt comprising a base fabric 2 of substantially uniform quality and surface batt fibre 1. In this case a film 23 made of polymer material and provided with openings is arranged between the batt fibre layer and the base fabric at the edge portions 20 of the press felt, which film reduces the permeance of the edge portions. Alternatively, the film can only be arranged in the midportion 30. Instead of the film, it is also possible to use any other separate structural layer that is arranged in the structure of the press felt.

Figure 10:
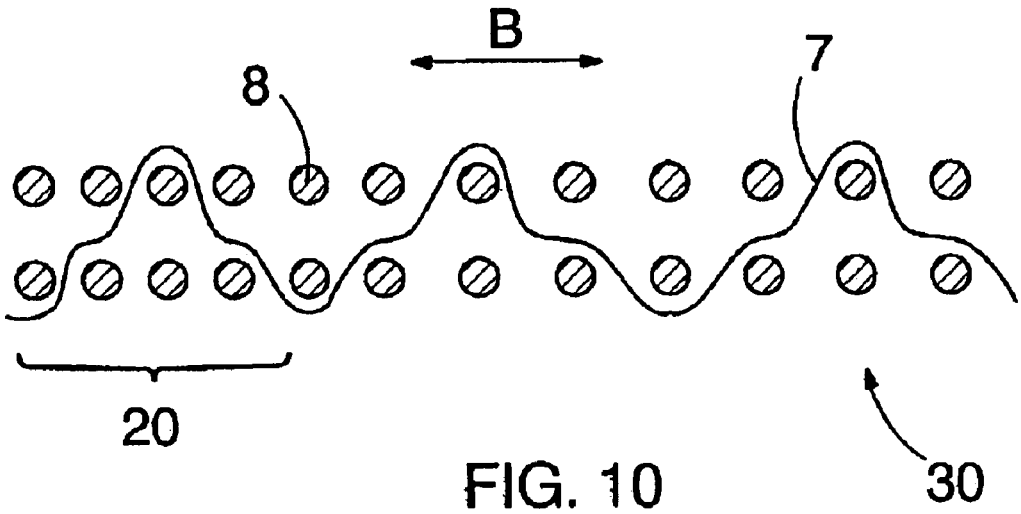
FIGS. 10 and 11 are schematic views of woven base fabric preforms seen in the running direction.
Figure 11:
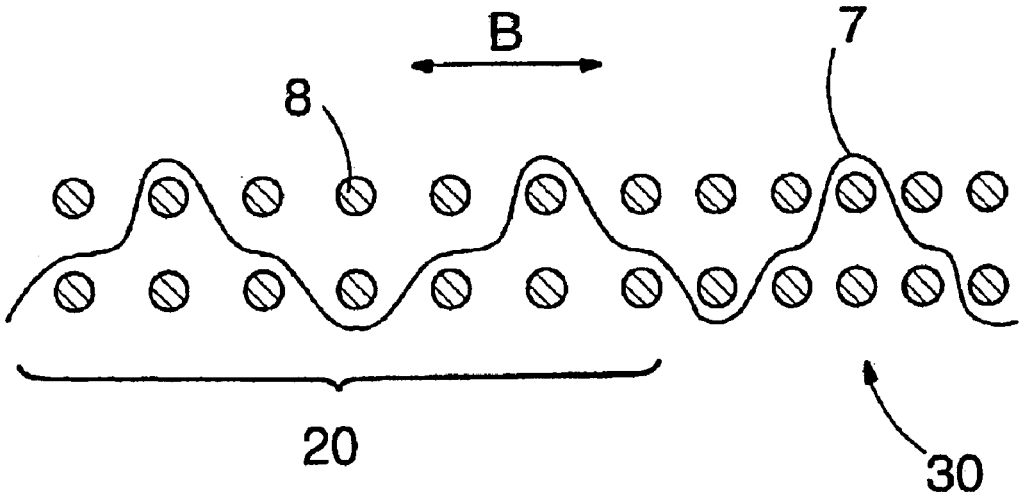

FIG. 10 shows a structure of a base fabric preform cut in the transverse direction B. The base fabric preform is a weave that is substantially as wide as the press felt and whose weft yarn 8 density in the edge portions 20 is higher than in the midportion 30. FIG. 15, in turn, shows a base fabric preform whose weft density is higher in the midportion 30 than in the edge portions 20. The press felt base fabric may consist of one single base fabric preform having a varying weft density, or alternatively, the base fabric preform may comprise a plurality of superimposed base fabric preforms, of which at least one is as shown in FIG. 10 or 11.

Furthermore, it is possible to influence the properties of the base fabric through the amount of warp yarns.

All combinations of the above-described embodiments can be applied if desired.

If desired, the base fabric or the base fabric preforms of the press felt can be woven directly into a closed loop. Alternatively, it is woven in a flat or horseshoe form, whereby there can be seam loops at the jointing edges for assembly into a closed loop or butt seams can be applied in the assembly. It is obvious to a person skilled in the art that the number of layers, weaves as well as the number and material of yarns of the base fabric can be selected case-specifically in order to achieve the desired result.

The drawings and the relating specification are only intended to illustrate the inventive idea. The details of the invention may vary within the scope of the claims. Thus, the base fabric need not necessarily be a woven fabric, but so-called non-woven fabrics are also possible. The base fabric can also be a knitted fabric.

What is claimed is:

1. A method of making a press felt, comprising:

forming at least one base fabric preform;

making the at least one base fabric preform into a closed-loop base fabric having predetermined dimensions in the cross-machine direction and the machine direction of a paper machine, and a first and a second longitudinal outer edge;

forming the base fabric of one or more base fabric preforms that are continuous in the cross-machine direction;

attaching at least one batt fibre layer onto the base fabric;

providing both of the longitudinal edges of the press felt with longitudinal edge portions of a predetermined width from the longitudinal outer edge of the press felt and providing a midportion in the longitudinal direction of the press felt between the edge portions; and attaching different numbers of batt fibre layers onto the edge portions from the midportion of the press felt, whereby the structure of the press felt edge portions differ from the midportion.

2. The method as claimed in claim 1, further comprising:

weaving the base fabric of warp yarns and weft yarns, weaving one or more superimposed base fabric layers of the same width as the press felt; and arranging yarn density in at least one of these layers to be different in the edge portions of the base fabric from the midportion of the base fabric.

3. The method as claimed in claim 2, further comprising:

gradually changing the difference in yarn density between the edge portion and the midportion over a predetermined transverse transition distance.

4. The method as claimed in claim 1, further comprising:

providing the edge portions and the midportion of the press felt with at least one different batt fibre layer.

5. The method as claimed in claim 1, further comprising:

forming a structural difference between the edge portions and the midportion of the press felt by treating at least one of said portions, during manufacture, with a polymer material, which penetrates into the press felt structure and makes the treated portions denser.

6. A press felt, which comprising:

a closed-loop base fabric, the base fabric being continuous in the cross-machine direction of the press felt;

at least one batt fibre layer attached onto the base fabrics;

longitudinal edge portions of a predetermined width in the cross-machine direction of the press felt and a midportion between said edge portions; and the number of batt fibre layers attached on the midportion of the press felt is different from the edge portions, whereby the structure of the edge portions is different from the midportion.

7. The press felt as claimed in claim 6, wherein at least in one layer, the base fabric yarn density in the edge portions differs from the midportion of the press felt.

8. The press felt as claimed in claim 6, wherein the batt fibre layers attached onto the base fabric are different in the midportion of the press felt as compared with the batt fibre layers in the edge portions.

9. The press felt as claimed in claim 8, wherein the batt fibre attached onto the midportion of the press felt has different properties as compared with the batt fibre in the edge portions.

10. The press felt as claimed in claim 6, wherein the structure of the edge portion comprises polymer material which clogs the edge portions to be denser than the midportion.

11. The press felt as claimed in claim 6, wherein the structure of the press felt midportion comprises polymer material, which clogs the midportion to be denser than the edge portions.

* * * * *